United States Patent [19]

Sobieniak

[11] Patent Number: 4,568,439

[45] Date of Patent: Feb. 4, 1986

[54] ELECTROLYTIC CELL HAVING IMPROVED INTER-ELECTRODE SPACING MEANS

[75] Inventor: Mathew G. Sobieniak, Lewiston, N.Y.

[73] Assignee: J. A. Webb, Inc., Buffalo, N.Y.

[21] Appl. No.: 617,578

[22] Filed: Jun. 5, 1984

[51] Int. Cl.[4] ..... C25B 13/02; C25B 13/04; C25B 9/00

[52] U.S. Cl. ..... 204/242; 204/253; 204/267; 204/279

[58] Field of Search ..... 204/267, 268, 269, 279, 204/286, 284, 242, 283

[56] References Cited

U.S. PATENT DOCUMENTS

| | | | |
|---|---|---|---|
| 1,609,771 | 12/1926 | Poland | 204/242 X |
| 3,674,676 | 7/1972 | Fogelman | 204/286 |
| 3,878,082 | 4/1975 | Gokhale | 204/283 X |
| 4,105,514 | 8/1978 | Justice et al. | 204/263 X |
| 4,174,259 | 11/1979 | Rucker et al. | 204/283 X |
| 4,377,462 | 3/1983 | Baker et al. | 204/267 X |
| 4,417,970 | 11/1983 | Yamaguchi et al. | 204/283 X |

*Primary Examiner*—Donald R. Valentine
*Attorney, Agent, or Firm*—Donald C. Studley

[57] ABSTRACT

An electrolytic cell is described which has a spacing means positioned between the anode and cathode faces. The present spacing means comprises a plurality of longitudinally elongated, electrically non-conductive spacers fabricated of a chemically resistant material being inert to the conditions existing within an operating electrolytic cell. The present spacers are positioned on the face portion of a foraminous anode. The spacers are secured on the anode face by extention of a portion of the spacer through an opening in the anode and are secured at the back portion of the anode.

9 Claims, 10 Drawing Figures

ELECTROLYTIC CELL HAVING IMPROVED INTER-ELECTRODE SPACING MEANS

BACKGROUND OF THE INVENTION

The present invention relates to improved electrolytic cells utilized for the decomposition of aqueous salt solutions. A number of industrial processes are based upon the electrolysis of such solutions. Among the most important is the electrolysis of alkali metal chlorides to produce chlorine and either the corresponding alkali metal hydroxide, or chlorate. Of the alkali metal chloride source materials, sodium chloride is the most abundant and most utilized.

The electrolysis process is commonly carried out in an electrolytic cell which consists of a cell compartment containing a plurality of spaced anodes and cathodes separated by a porous diaphragm or separator. For some years, a layer of fibrous asbestos was utilized as the diaphragm. More recently, with the advent of metal, or dimensionally stable anodes, perm selective separators, such as fluorocarbon resin modified abestos mixtures, have substantially replaced the sole use of abestos as the diaphragm component.

The spacing between the anode and the cathode is economically important as the amount of electrolyte that fills the space, or gap, has an electrical resistance requiring additional electrical energy to operate the cell. The additional energy used results in a temperature increase in the electrolyte which ultimately limits the current density at which the cell may be operated.

If the gap could be arbitrarily selected it would be chosen to maintain the cell voltage as close as possible to the decomposition voltage of the electrolyte. Thus a narrow, but discrete, space between the electrodes is highly desirable. However, because of the broad areas of anode and cathode that require spacing, the desired spacing is difficult to obtain and to subsequently maintain. In addition, in the assembly of an electrolytic cell, it is important to provide a means of guiding the electrodes into the cell compartment without damaging the coated surface of the anode and to avoid disrupting the diaphragm. Generally inter-electrode distances presently in the range from about 1/32 to about $\frac{1}{4}$ inch, and more preferably from about 1/16 to about $\frac{1}{8}$ inches.

Various methods and techniques have been proposed to place the electrodes into the desired spaced relation and to maintain them in such relation during operation of the cell. For example, U.S. Pat. No. 3,247,090 teaches the use of metal spacers attached to the cathodes; U.S. Pat. No. 3,477,939 teaches the use of spacer blocks attached to the anode; U.S. Pat. No. 3,732,153 teaches plastic cords wrapped around the cathode, and; U.S. Pat. No. 3,975,255 describes the use of non-conductive spacers positioned on the anode edges.

STATEMENT OF THE INVENTION

The present invention provides an efficient and means to provide and maintain a set, or desired, spacing between the anodes and cathodes of electrolytic cells. The present invention allows the anodes and cathodes to be aligned in a spaced relation during assembly and maintained in such relation during operation of the cell. The present spacers maintain a spaced relation of the electrodes and substantially reduces the chance of short circuiting or abrasion. Installation and removal of anodes and cathodes, although not frequently carried out, may be effected simply and with reduced chance of damage to the electrodes. The present spacing means requires little maintenance or supervision and functions to continuously maintain such spacing during cell operation.

The present spacing means comprises a plurality of longitudinally elongated, electrically non-conductive spacers fabricated of a chemically resistant material being inert to the conditions existing within an operating electrolytic cell. The present spacers are positioned on the face portion of a foraminous anode. The spacers are secured on the anode face by extention of a portion of the spacer through an opening in the anode and are secured at the back portion of the anode. Preferably the spacers are solid, and in the form of lines or cords. The thickness of the spacer determines the gap while maintaining the anode and cathode out of physical (and electrical) contact. The elongated spacers preferably positioned in a parallel relation along the anode face allowing circulation of electrolyte between the anode and cathode. The length of the spacers, preferably extends over at least 90% and more preferably over 95% of the width or height of the anode. Although the spacers may be attached vertically, horizontally or diagonally over the anode face, it is preferred that they be applied vertically to facilitate ease of assembly of the cell components into an operative electrolytic cell. Preferably a plurality of spacers are positioned in spaced relation to each other across the anode face allowing generally between about 6 to about 18 inches, and more preferably from about 8 to about 12 inches, between each spacer.

The spacers may be of any cross-sectional configuration. The width or diameter of the spacer determines and maintains the spacing between the electrodes. For purposes of fabrication and installation, it is preferred that the spacers of the present invention have a substantially round or circular, cross-section.

The present spacers are fabricated of an electrically non-conductive material which is chemically inert to the conditions in an operating electrolytic cell. Materials such as fluorine containing polymers are aptly suited, for example, polytetrafluroethylene, (PTFE), ethylenetetrafluorethylene (ETFE) copolymer, ethylene-chlorotrifluroethylene (ECTFE) copolymer, perfluoroalkoxy (PFA) resin, tetrafluoroethylene-hexafluoropropylene copolymer, (FEP) polyvinylfluoride, (PVF), polyvinylidene fluoride (PVDF), polychlorotrifluoro-ethylene (PCTFE), are useful. Polytetrafluoroethylene (PTFE), commonly known as Teflon, is readily available and eminently useful.

The present invention facilitates the installation of spacers prior to assembly of the cell and allows the use of flexible spacer materials, such as Teflons. In contrast, elongated prior art spacers, so-called "hairpins" are installed after the anodes and cathodes are in position by pushing the spacer between the anode and cathode. Such spacers are of necessity fabricated of a rigid material, such as Kynar, a fluorocarbon polymeric material, such as Kynar, a fluorocarbon polymeric material fabricated by Pennwalt Corp. Such rigid materials are frequently susceptable to distortion, stress cracking, or embrittlement which substantially shortens the life of the spacer and makes reuse extremely difficult.

The present spacers are particularly useful in conjunction with expandable such as those described in U.S. Pat. No. 3,674,676.

DETAILED DESCRIPTION OF THE INVENTION

The invention will now be described in detail by reference to the accompanying drawings in which similar numbers represent similar components throughout the several drawings.

FIGS. 4A, 4B, 4C, 4D, 4E, 4F, and 4G are perspective views illustrating several alternative means of securing the spacer on the back portion of an anode.

Figure 1:
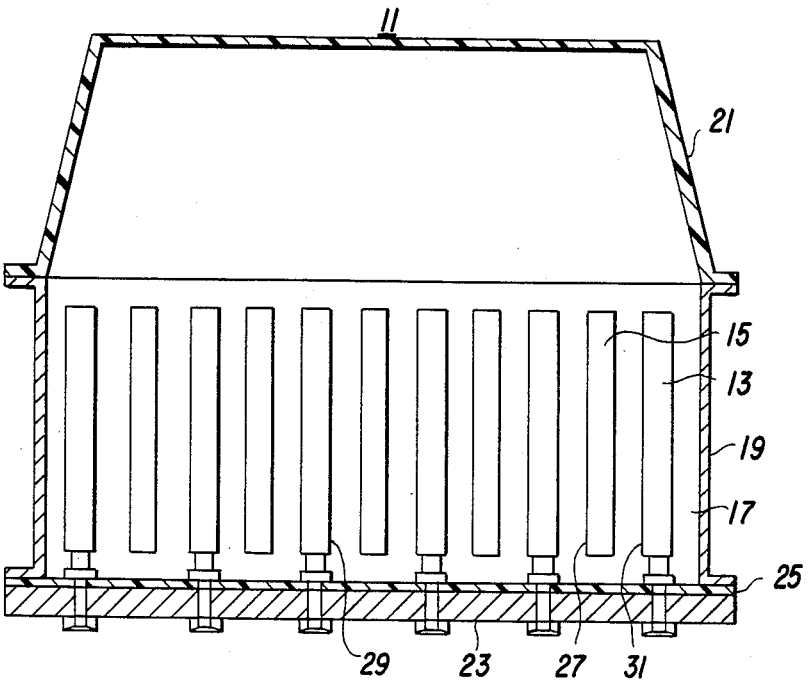
FIG. 1 is a schematic, side elevation of a typical diaphragm-type electrolytic cell equipped with spacers in accord with the present invention.

Looking now at FIG. 1, cell, generally indicated by 11, has a plurality of electrodes, such as dimensionally stable anodes 13 and corresponding cathodes 15 positioned within cell compartment 17. Cell compartment 17 has side walls 19 and top 21. Typically the top portion is removeable to allow access to the interior of the cell compartment. A conductive base member 23 is typically separated from the interior of the cell compartment by a non-conducting blanket, such as 25. Anode members 13 are positioned in electrical contact with such base member.

Anode members 13 may be in any configuration, however, in most commercial applications the anodes, and to those which the present invention is directed, are in the form of foraminated sheets or blades, for example, expanded or perforated metals. The cathode members 15 generally correspond to the configuration of the anode to facilitate maximum interfacial area between the electrodes. Cathode members are preferably fabricated of a screen or expanded metal and support a diaphragm 27. Diaphragm 27 is fabricated of a fluid-permeable and chemically resistant material. Suitable diaphragm materials include abestos fibers, polyvinyl chloride, polypropylene, polytetrafluorethylene or mixtures thereof.

Anodes 13 are spaced positioned from cathodes 15 along their interfacial area by spacers 29 attached to the anode face 31.

Figure 2:
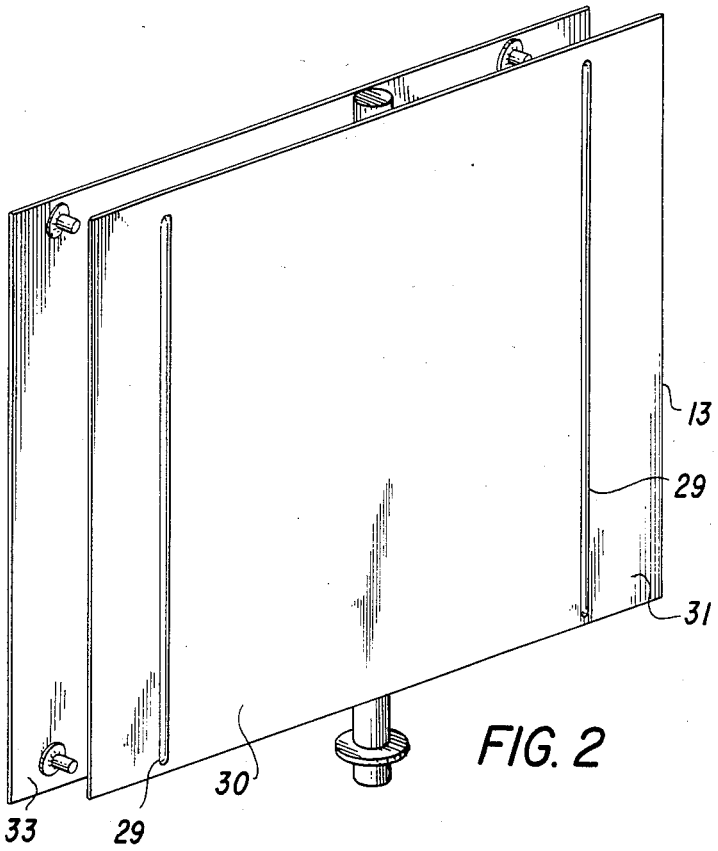
FIG. 2 is a perspective view illustrating a portion of the anode face, such as that shown in FIG. 1, equipped with secured spacers.

FIG. 2 shows in detail a portion of an anode 13 of FIG. 1, in prespective and illustrates the use of spacers 29 on the face of foraminated anode 13.

Figure 3:
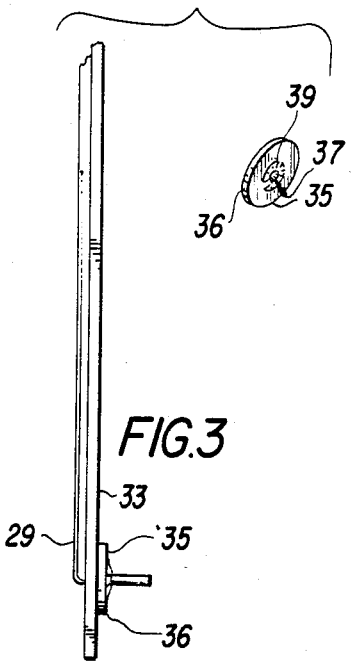
FIG. 3 is a perspective view of the back portion of an anode showing a preferred method of securing the present spacer.
Figure 4A:
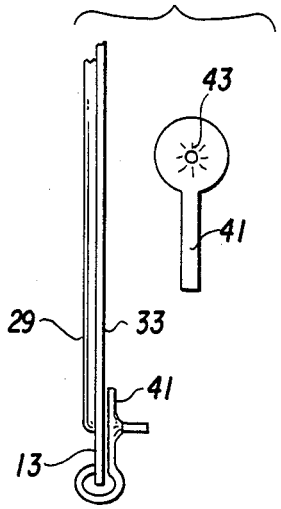
Figure 4B:
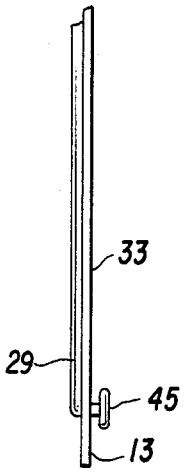
Figure 4C:
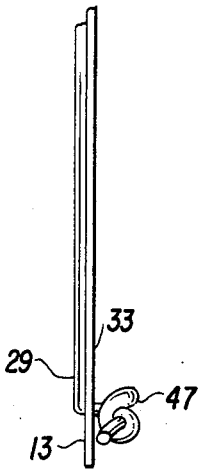
Figure 4D:
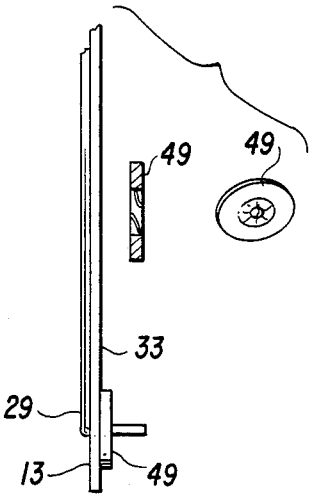
Figure 4E:
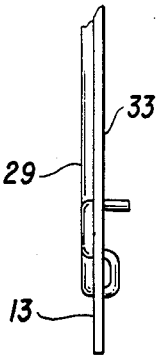
Figure 4F:
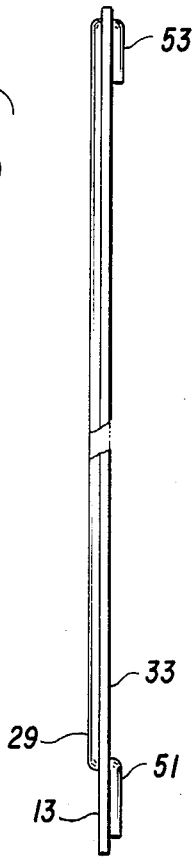
Figure 4G:
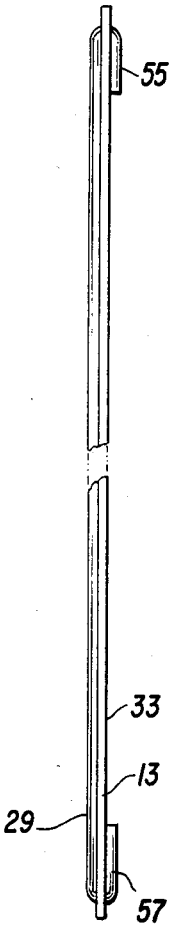

FIG. 3 shows in detail the back portion of an anode, such as anode 13 of FIG. 1. This figure illustrates a preferred means of securing the spacer to the back portion of the anode. In this embodiment spacer 29 extends through a space in foraminous anode 13 and is secured at the back portion thereof by means of a slotted spring washer 36. Such type fasteners are commercially available. They generally have an opening in the center which has a plurality of inwardly arranged teeth 37. The use of slotted spring washer 36 allows spacer 29 to be easily pulled through washer 36, and secured, while strongly resisting movement of the spacer in the opposite direction. The present slotted spring washers are preferably fabricated of titanium, and in a more preferable embodiment, are coated on all outside faces with an electrically non-conductive, chemically resistant material 35 for example, a fluorine containing polymer. A particularly useful coating is Teflon.

FIGS. 4A through 4G show in detail a number of alternative means of securing spacers 29 to the back portion of anode 13. For example, in alternative designated 4A, spacer 29 may be secured by a tab 41 of a chemically resistant material, such as titanium. Tab 41 has a plurality of teeth 43 therein to receive a portion of spacer 29 allowing insertion therethrough, but preventing withdrawal. Tab 41 may be secured to anode 13 by bending. In alternative 4B, spacer 29 is fused on the end portion 45 thereof which extends through an opening in anode 13 to the back portion thereof and secures spacer 29 to anode 13. In alternative 4C spacer 29 is secured by knot 47. In alternative 4D spacer 29 is secured by a threaded fastener 49. In alternative 4E spacer 29 is woven through the openings in anode 13.

In alternatives 4F and 4G spacer 29 is secured to the back of anode 13 by the use of a thermoplastic material as the spacer which may be shaped at temperatures above 250° F., for example, polyvinylidene fluoride. In alternative 4F spacer 29 is pre-shaped by heating, along portion 51. Portion 51 is inserted through an opening in anode 13. Spacer 29 is then positioned along the face of anode 13 and secured at the back portion 33 thereof by inserting portion 53 through an opening, or partial opening in the case the anode edge is utilized, in anode 13 and heating portion 53 to shape and secure the spacer 29 on anode 13 at the back portion 33 thereof.

In alternative 4G spacer 29 is secured to the back portion 33 of anode 13 by bending and shaping portions 55 and 57 inserted through openings in anode 13.

In operation the cell is filled to a suitable level with an electrolyte. A source of electrical current is applied to base number 23 which in turn conducts a flow to anodes 13 through the layer of electrolyte maintained between the faces of the electrodes and to cathode 15. Upon passage of current, the electrolyte is decomposed. In the case of a sodium chloride electrolyte chlorine is formed at the anode and hydrogen at the cathode.

The foregoing description and embodiments are intended to illustrate the invention without limiting it thereby. It will be understood that various modifications may be made in the invention without departing from the spirit or scope thereof.

What is claimed is:

1. In an electrolytic cell comprising a cell compartment, a conductive metal base an electrically non-conductive sheet within said compartment covering and in contact with said base, a plurality of anode members of foraminous metal mounted within said compartment in electrical contact with said base member, the bottom portion of said anode members passing through said sheet and forming a liquidtight seal separating said base member from said cell compartment, a plurality of cathode members positioned intermediate said anode members the improvement which comprises a plurality of elongated, longitudinal spacers positioned on a the face portions of said anodes by extension of a portion of said spacers through open spaces in said foraminous anodes and secured on the back portion of said anodes, said spacers being fabricated of an flexible, electrically non-conductive material, inert to the conditions existing within an operating electrolytic cell, and said spacers maintaining a desired spaced relation the distance between the faces of said anode face members and the faces of said cathode members.

2. The electrolytic cell of claim 1 wherein said spacers have a circular cross-section.

3. The electrolytic cell of claim 1 wherein said spacers are fabricated of a fluorine containing polymer.

4. The electrolytic cell of claim 3 wherein spacers are fabricated of polytetrafluroethylene.

5. The electrolytic cell of claim 1 wherein the spacers are fabricated of polyvinylidene fluoride.

6. The electrolytic cell of claim 1 wherein said spacers are secured to the back portion of said anodes by means of slotted spring washers.

7. The electrolytic cell of claim 6 wherein said washers are fabricated of titanium.

8. The electrolytic cell of claim 6 wherein said titanium washers are coated on all outside faces by a fluorine containing polymer.

9. The electrolytic cell of claim 8 wherein said coating is fluorinated ethylene propylene.

* * * * *